US010207141B2

(12) United States Patent
Belveal

(10) Patent No.: US 10,207,141 B2
(45) Date of Patent: Feb. 19, 2019

(54) HANDS-FREE MIDDLE BACK EXERCISE APPARATUS

(71) Applicant: Kenneth Marshall Belveal, Houston, TX (US)

(72) Inventor: Kenneth Marshall Belveal, Houston, TX (US)

( * ) Notice: Subject to any disclaimer, the term of this patent is extended or adjusted under 35 U.S.C. 154(b) by 0 days.

(21) Appl. No.: 14/874,406

(22) Filed: Oct. 3, 2015

(65) Prior Publication Data

US 2017/0106228 A1 Apr. 20, 2017

(51) Int. Cl.

| | |
|---|---|
| ***A63B 21/00*** | (2006.01) |
| ***A63B 21/04*** | (2006.01) |
| ***A63B 21/05*** | (2006.01) |
| ***A63B 21/055*** | (2006.01) |
| ***A63B 23/02*** | (2006.01) |
| ***A63B 23/12*** | (2006.01) |

(52) U.S. Cl.

CPC ..... *A63B 21/4007* (2015.10); *A63B 21/0428* (2013.01); *A63B 21/0555* (2013.01); *A63B 21/4017* (2015.10); *A63B 23/0233* (2013.01); *A63B 23/1245* (2013.01); *A63B 21/00065* (2013.01); *A63B 21/00069* (2013.01); *A63B 21/0557* (2013.01); *A63B 2225/09* (2013.01)

(58) Field of Classification Search

CPC ..... A63B 21/00; A63B 23/0233; A63B 21/04–21/0557; A63B 21/4007

USPC ..... 482/141

See application file for complete search history.

(56) References Cited

U.S. PATENT DOCUMENTS

| | | | | |
|---|---|---|---|---|
| 3,322,425 | A * | 5/1967 | Moore | A63B 21/072 482/105 |
| 3,529,820 | A * | 9/1970 | Templeton | A63B 21/0004 482/122 |
| 3,718,329 | A * | 2/1973 | Sabo | A63B 21/28 273/451 |
| 4,890,841 | A * | 1/1990 | Brooks | A63B 69/0059 473/212 |
| 5,614,300 | A * | 3/1997 | Cicali | A63B 21/0004 428/193 |
| 5,711,747 | A * | 1/1998 | Steinback | A63B 21/0004 482/122 |
| 6,537,160 | B2 * | 3/2003 | Chrystal | A63B 69/0059 473/213 |
| 8,771,155 | B1 * | 7/2014 | Bell | A63B 69/0059 482/124 |
| 8,968,121 | B2 * | 3/2015 | Leggett | A63B 69/0002 473/422 |
| 9,592,418 | B2 * | 3/2017 | Burrell | A61F 5/026 |

(Continued)

*Primary Examiner* — Nyca T Nguyen
(74) *Attorney, Agent, or Firm* — Pierson IP, PLLC

(57) ABSTRACT

This invention relates to health and fitness and more particularly to exercise methods and devices. This invention is directly related to strengthening the muscles between the shoulder blades associated with poor posture, without the use of the hands. The exercise apparatus comprises two adjustable fabric loops connected to a rubber loop. The user slips one arm into each fabric loop pulling the device up to rest on the back of the upper arms with the rubber loop resting across the front of the body just above chest height. User then contracts the shoulder blades together and down which creates resistance on the rubber loop strengthening the muscles between the shoulder blades.

3 Claims, 7 Drawing Sheets

(56) References Cited

U.S. PATENT DOCUMENTS

| | | | | |
|---|---|---|---|---|
| 2005/0227814 | A1* | 10/2005 | Takemura | A63B 21/0004 482/44 |
| 2014/0128231 | A1* | 5/2014 | Menaker | A63B 21/00047 482/145 |
| 2014/0171236 | A1* | 6/2014 | Oravecz | A63B 59/0014 473/518 |
| 2014/0171275 | A1* | 6/2014 | Tatum | A63B 21/0004 482/124 |
| 2014/0243175 | A1* | 8/2014 | Huang | A63B 21/00047 482/142 |
| 2014/0315666 | A1* | 10/2014 | Medley | A63B 69/0059 473/450 |

* cited by examiner

HANDS-FREE MIDDLE BACK EXERCISE APPARATUS

FIELD OF THE INVENTION

This invention relates to health and fitness and more particularly to exercise methods and devices. This invention is directly related to strengthening the muscles between the shoulder blades associated with poor posture.

BACKGROUND OF THE INVENTION

Poor posture is widespread. The lack of daily manual exercise coupled with the current technology age means many hours sitting at a computer desk or long commutes in automobiles. The commonality is arms in front of the body for lengthy periods of time which tends to draw the shoulders forward and down making the chest muscles tight and the middle back muscles long and weak. The resulting effects can manifest in many ways from tension headaches to sore necks, achy shoulders and problematic backaches. This can result in missed work days and a reduced quality of life and oftentimes depression and poor self-esteem.

Building strong muscles creates a better skeletal foundation. Strong muscles keep bones aligned preventing injury caused by repetitive activities and are better able to adapt to physical and environmental stressors which help decrease the risk of injury caused by sudden movements. Strong muscles contribute to strong bones as the stronger the muscles become, the stronger the bones become to support the increased tension.

There are many methods of working the muscles of the middle back. The difficulty in targeting the muscles of the middle back becomes apparent regardless of whether exercise machines, free weights or exercise bands are used. When using the hands to grasp the resistance, there are stronger muscles that may limit the proper contraction of the middle back muscles. A common exercise to work the middle back is a row, as in rowing a boat. The proper exercise protocol is squeezing the shoulder blades together followed by bringing the elbows back past the midline of the body. Most people perform the exercise incorrectly by pulling back with the elbows first using momentum to contract the middle back. However, performed this way recruits the largest and strongest muscles in the upper body, the latissimus dorsi, responsible for bringing the arms behind the midline of the body, or shoulder extension. It also recruits the biceps brachii, responsible for bending the elbow, or elbow flexion. These two muscle groups do the lions' share of the work leaving the middle back under-trained and underdeveloped.

When using the hands to grasp a resistance, the middle back's contractibility will also be affected if there are weaker muscles associated with a movement which targets the middle back. The reverse press is a good example. It is similar to a row but the elbows are raised to shoulder height. If there is a weakness in the rear deltoid, the movement is not performed correctly or to its fullest contraction which will not properly contract the middle back.

This invention will eliminate the use of the larger, stronger muscles and minimize weaker muscles involved in exercises using the hands to grasp a resistance thus properly targeting the muscles responsible for shoulder girdle retraction and depression.

Because of the expense of health club memberships and the time required to travel to health clubs, many people desire to exercise at home. However, many exercise machines are very expensive and require a dedicated area or room for use and/or storage. Also, it is impossible to use large in-home exercise machines while travelling. For these reasons many people do not wish to own a large exercise machine. This device solves these problems as it is light, small and portable.

SUMMARY OF THE INVENTION

The invention is designed to provide a tensile exercise device which is portable, adjustable, convenient, safe and comfortable and targets the muscles of the middle back which control shoulder girdle retraction and depression imperative to proper posture, without use of the hands during the exercise.

The invention comprises two adjustable fabric loops connected by a rubber loop. The user slips one arm into each fabric loop pulling the device up so that the rubber loop rests on the front of the body just above chest height. The fabric loops rest on the back of the upper arms just below armpit level. User then contracts the shoulder blades together and down which creates resistance on the rubber loop strengthening the muscles between the shoulder blades.

The exercise device is readily adjustable, both in terms of length and resistance. Each fabric loop is adjustable by a webbing slide allowing the loop to be larger or smaller depending on the size of the user. The size of the fabric loops and the number of rubber loops control the resistance. The nature of the invention allows the muscles of the middle back, which are responsible for shoulder girdle retraction and depression—middle and lower trapezius muscles and the rhomboid muscles—to be worked independent of either the latissimus dorsi (shoulder extension) or the biceps brachii (elbow flexion). Both muscle groups are more readily used while performing a pulling motion with the upper body when the hands grasp a resistance device. This method properly works the muscles responsible for shoulder girdle retraction and depression improving the user's posture.

The fabric loops are wide enough to spread the resistance along the length of the upper arm preventing pinching and binding and are padded with foam for cushioning while the rubber loop provides resistance to work the middle back. Mother's repeatedly tell their children to have good posture—stand up straight and shoulders back. This invention allows the user to imitate that movement with resistance which strengthens those muscles responsible for the movement and allowing the muscles to retain that tension for longer periods of time thus improving posture.

In operation, the exercise device can be easily adjusted. Adjustments can be made in the size of the fabric loop by moving the position of the nylon strap in relation to the webbing slide. The user will adjust the length of each nylon strap so that the upper arms are in line with the midline of the body. This is the starting point of the movement. The user is then instructed to squeeze the shoulder blades together and down to create resistance on the rubber loop. Since the hands are not used during the movement phase, the latissimus dorsi muscles, responsible for shoulder extension, and the biceps brachii, responsible for elbow flexion, are taken out of the movement. This allows for direct contraction of the muscles responsible for shoulder girdle retraction and depression. Adjustments to the device's resistance can be made by adding or subtracting rubber loops or adjusting the size of the fabric loops.

DETAILED DESCRIPTION

Figure 1:
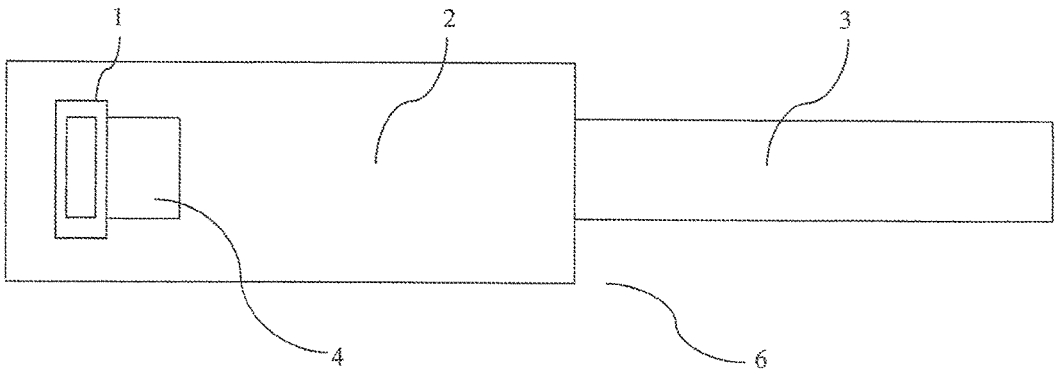
FIG. 1—Outside view of one of two adjustable fabric loops that is open—nylon strapping is not connected to the webbing slide.

An exercise device designed to strengthen the muscles of the middle back encouraging improved posture and comprising:

FIG. 1—Outside view of one of two adjustable fabric loops (6) which is not connected and is comprised of the following:

a. Tough fabric material (2) rectangular in shape.
b. Sewn to one end of the smaller rectangular side of the tough fabric material (2) is a smaller rectangular shape comprised of nylon strapping (3).
c. Attached to the outside and opposite smaller end of the tough fabric material (2) is a webbing slide (1) which is secured to the tough fabric material (2) by sewing a smaller rectangular piece of tough fabric material (4) to it.

Figure 2:
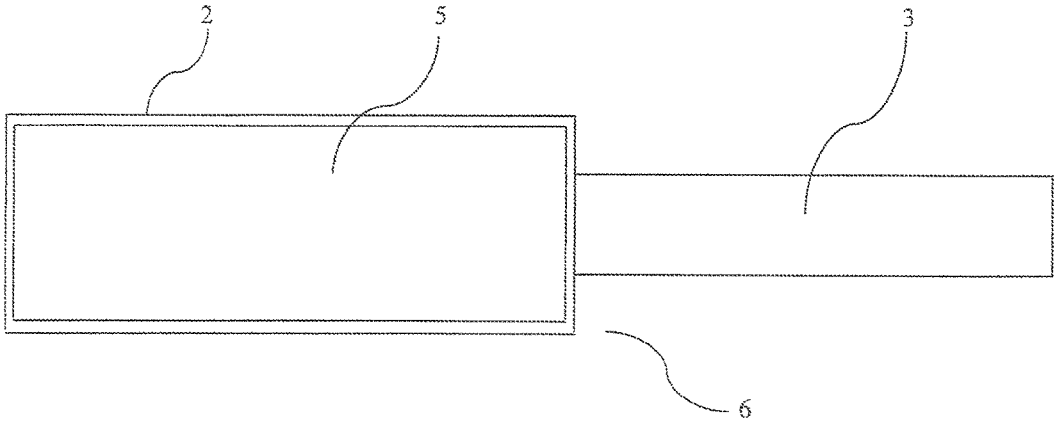
FIG. 2—Inside view of one of two adjustable fabric loops that is open—nylon strapping is not connected to the webbing slide.

FIG. 2—Inside view of one of two adjustable fabric loops (6) which is not connected and is comprised of the following:

a. Tough fabric material (2) which is rectangular in shape.
b. Sewn to one end of the smaller rectangular side of the tough fabric material (2) is a smaller rectangular shape comprised of nylon strapping (3).
c. Sewn to the inside of the rectangular tough fabric material (2) is a slightly smaller rectangular-shaped piece of foam (5) which is used as padding for comfort.

Figure 3:
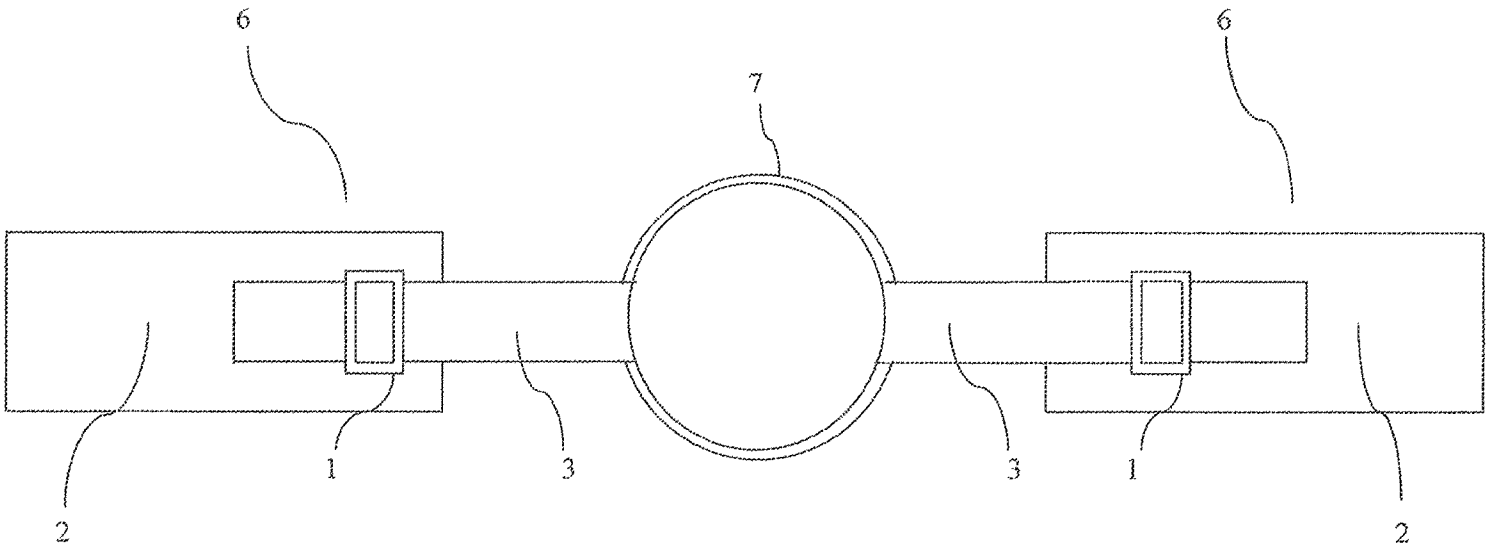
FIG. 3—Front view of two closed fabric loops connected to a rubber loop.

FIG. 3—Front view of two adjustable fabric loops (6) which are connected to a rubber loop (7) by passing each nylon strapping (3) through the rubber loop (7) and then inserting the ends of each nylon strapping (3) into their respective webbing slides (1). The size of each fabric loop (6) is adjusted by moving the position of the nylon strapping (3) in relation to the webbing slide (1).

Figure 4:
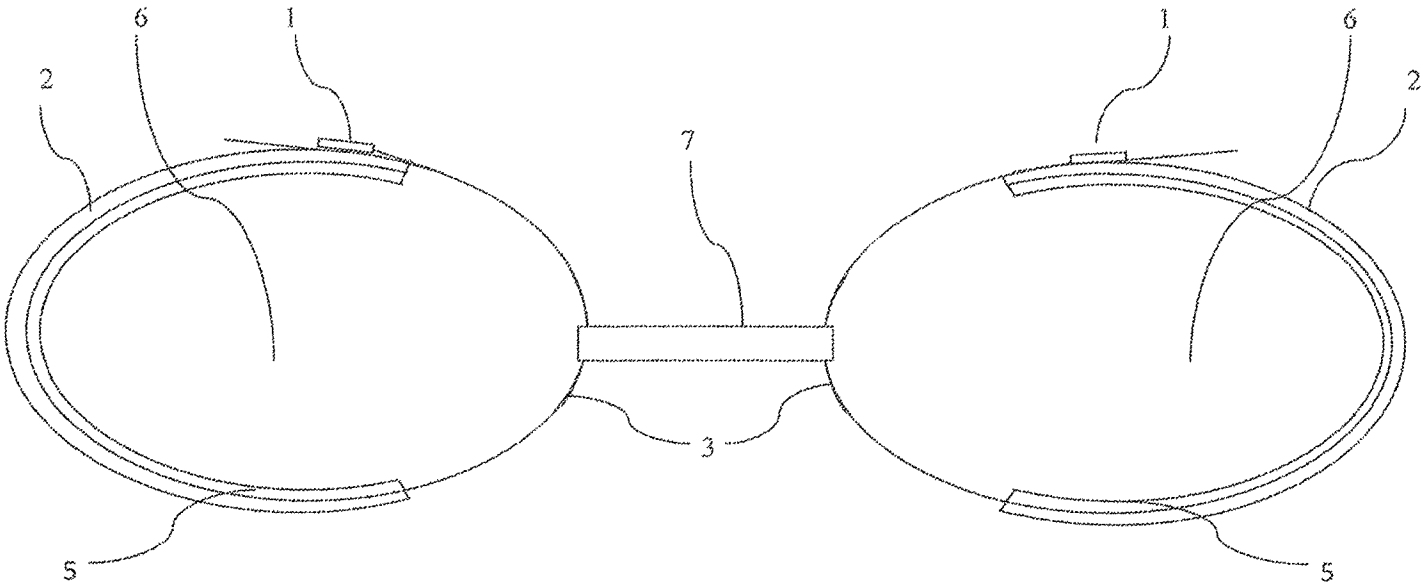
FIG. 4—Top view of two closed fabric loops connected to a rubber loop.

FIG. 4—Top view of two adjustable fabric loops (6) which are connected to a rubber loop (7) by passing the nylon strapping (3) through the rubber loop (7) and then inserting the ends of each nylon strapping (3) into their respective webbing slides (1). The size of each fabric loop (6) is adjusted by moving the position of the nylon strapping (3) in relation to the webbing slide (1). This view shows the foam (5) sewn to the inside of the tough fabric material (2) for padding used for comfort.

Figure 5:
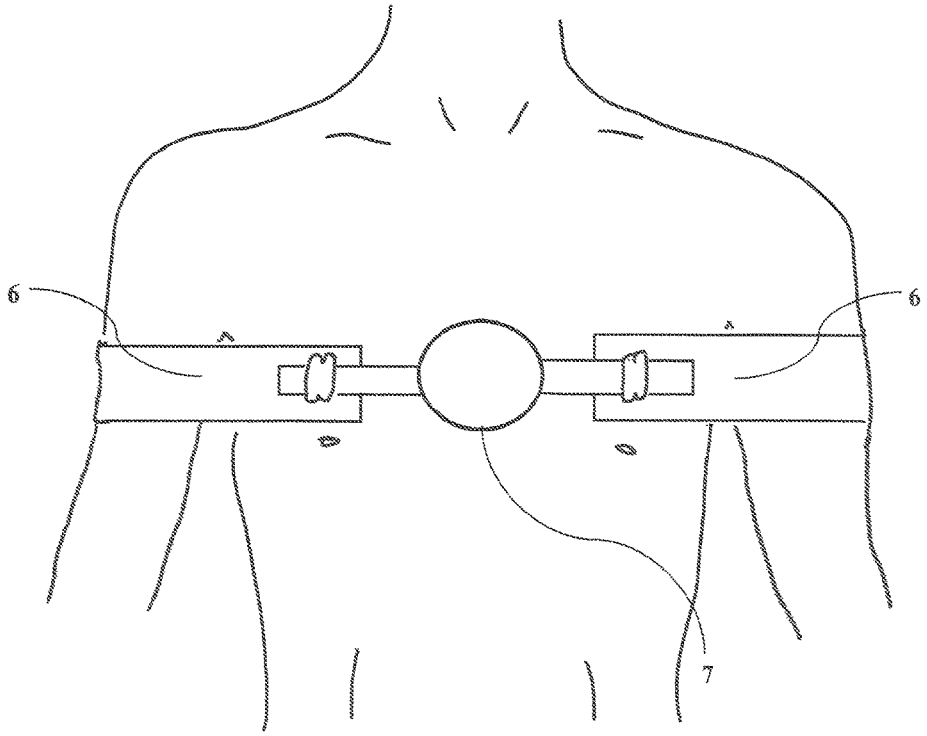
FIG. 5—Anterior view of a person with the invention in place and ready to use.

FIG. 5—Anterior view of a person with the invention in place and ready to use. The user places one arm in each fabric loop (6) and slides the invention up the arms until the fabric loops (6) reach armpit height and the rubber loop (7) rests above and against the chest.

Figure 6:
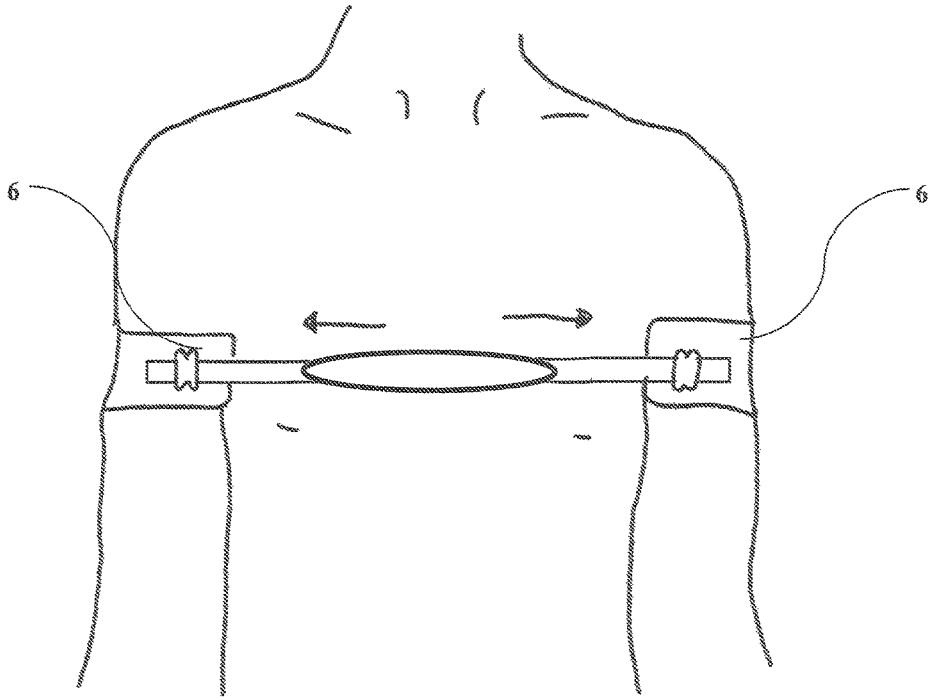
FIG. 6—Anterior view of a person with the invention being used by squeezing the shoulder blades together and down.

FIG. 6—Anterior view of a person with the invention in place and being used by squeezing shoulder blades together and down using the resistance created by elongating the rubber loop (7) to strengthen the muscles of the middle back, the middle trapezius, low trapezius and rhomboids.

Figure 7:
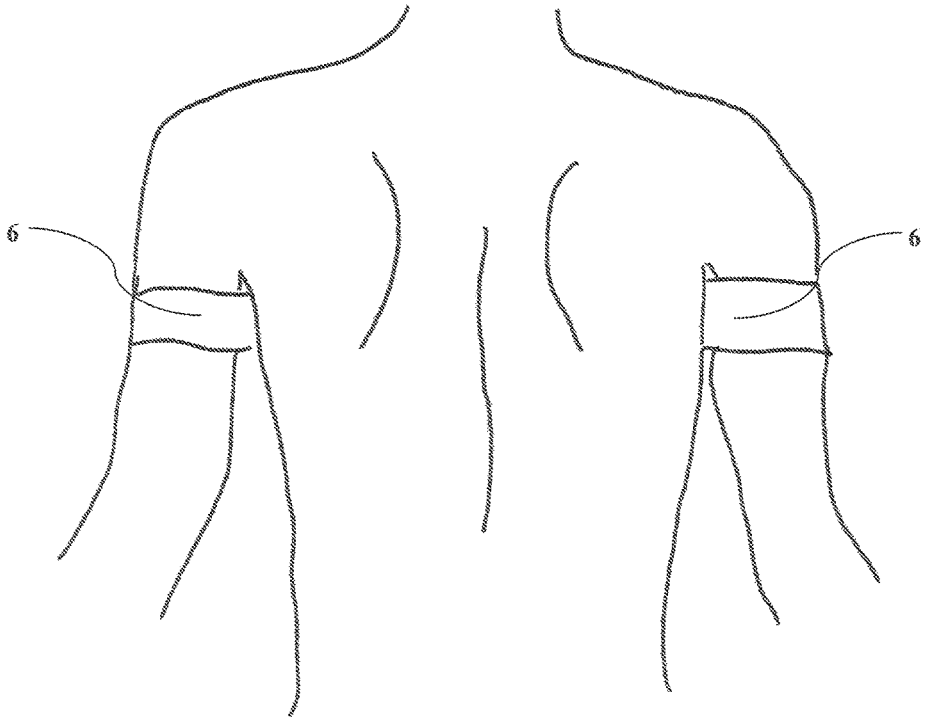
FIG. 7—Posterior view of a person with the invention in place and ready to use.

FIG. 7—Posterior view of a person with the invention in place and ready to use. The user places one arm in each fabric loop (6) and slides the invention up the arms until each fabric loop (6) reaches armpit height.

Figure 8:
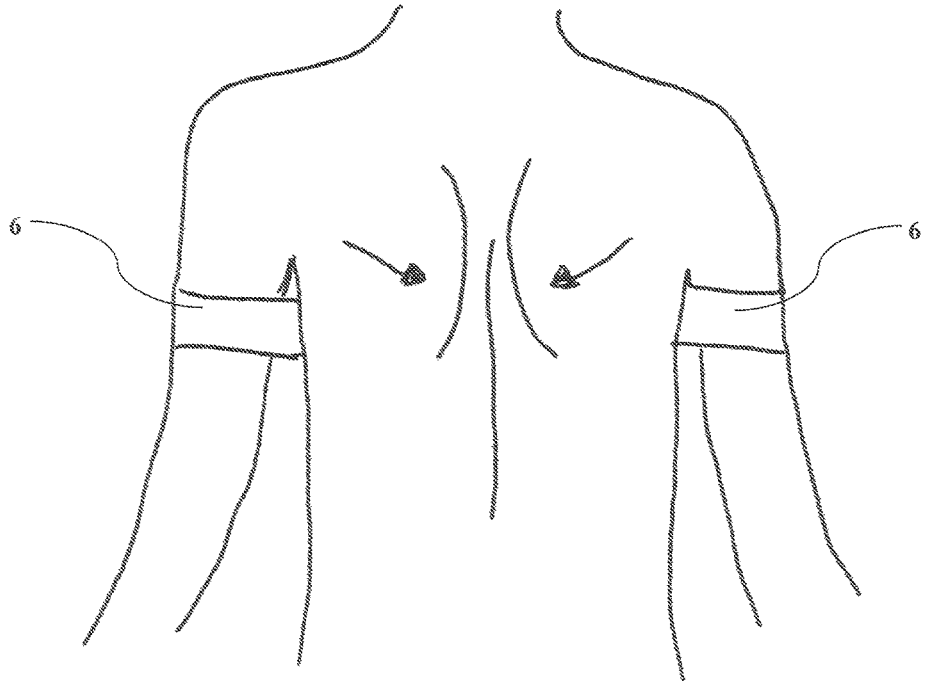
FIG. 8—Posterior view of a person with the invention being used by squeezing the shoulder blades together and down.

FIG. 8—Posterior view of a person with the invention in place and being used. The user places one arm in each fabric loop (6) and slides the invention up the arms until each fabric loop (6) reaches armpit height. The user then squeezes the shoulder blades together and down using the resistance created by elongating the rubber loop to strengthen the muscles of the middle back, the middle trapezius, low trapezius and rhomboids.

The invention is designed to provide a tensile exercising device which is portable, adjustable, convenient, safe and comfortable and targets the muscles of the middle back which control shoulder girdle retraction and depression imperative to proper posture, without use of the hands during the movement.

The invention comprises two adjustable fabric loops connected by a rubber loop. The exercise device is readily adjustable, both in terms of length and resistance. The ends of each fabric loop are connected together by a webbing slide allowing each loop to be larger or smaller depending on the size of the user. The size of each fabric loop, and the number of rubber loops used, control the resistance. The nature of the invention allows the muscles of the middle back—the middle and lower trapezius muscles and the rhomboid muscles—to be worked independent of either the latissimus dorsi or the biceps bracii. This method properly works the muscles responsible for shoulder girdle retraction and depression improving the user's posture. The fabric loops are wide enough to spread the resistance along the length of the upper arm preventing pinching and binding and are padded with foam for cushioning while the rubber loop provides resistance to work the upper back. Mothers repeatedly tell their children to have good posture—stand up straight, shoulders back, chest out. This invention allows the user to imitate that movement with resistance which strengthens those muscles responsible for the movement and allowing the muscles to retain that tension for longer periods of time thus improving posture.

The invention is designed to provide a tensile exercising device which is portable, adjustable, convenient, safe and comfortable and targets the muscles of the upper back which control shoulder girdle retraction and depression imperative to good posture, without use of the hands during the movement.

The invention comprises two adjustable fabric loops connected by a rubber loop. The user slips one arm into each fabric loop pulling the device up so that the rubber loop rests on the front of the body just above chest height. The fabric loops rest on the back of the upper arms just below armpit level. User then contracts the shoulder blades together and down which creates resistance on the rubber loop and tension on the muscles involved thus strengthening those muscles between the shoulder blades—middle trapezius, lower trapezius and rhomboids.

In operation, the exercise device can be easily adjusted. Adjustments can be made to the size of the fabric loop by moving the position of the nylon straps in relation to the webbing slide. The user will adjust the length of each nylon strap so that the upper arms are in line with the midline of the body. This is the starting point of the movement. The user is then instructed to squeeze the shoulder blades together and down to create resistance on the elastic band. Adjustments in the device's resistance can be made by adjusting the length of the nylon strap in relation to the webbing slide or by adding rubber loops.

The invention claimed is:

1. An exercise device, comprising:

a first loop and a second loop, each loop formed of a fabric material and both the first loop and the second loop being adjustable and configured to fit around an arm of a user, the first loop and the second loop formed of the fabric material having a first width;

a webbing slide positioned between a proximal end and a distal end of the first loop, wherein the first width is larger than the webbing slide;

a third loop extending through and connecting the first loop and the second loop and made of an elastic material, the third loop being configured to be positioned above a chest of the user;

the first loop comprising a first strap having a first end that is permanently coupled to the fabric material and a second end configured to be inserted through the third loop and slide within the webbing slide to change a distance between the webbing slide and the third loop, the first strap having a second width, the second width being smaller than the first width.

2. The exercise device of claim 1, further comprising a foam pad disposed on the interior circumference of both the first loop and the second loop, wherein the first end of the first strap is coupled to an exterior circumference of the first loop.

3. A method for using an exercise device, comprising:

positioning a first arm through a first loop formed of a fabric material having a first width;

positioning a second arm disposed through a second loop formed of a fabric material;

coupling a first end of a first strap of the first loop to the fabric material of the first loop formed of the tough fabric material, the first strap having a second width, wherein the second width is smaller than the first width;

inserting a second end of the first strap through a third loop;

sliding the second end of the first strap within a webbing slide to change a distance between the webbing slide and the third loop, the third loop extending through and connecting the first loop and the second loop and being made of an elastic material, wherein the webbing slide is positioned between a proximal end and a distal end of the first loop, wherein the first width is larger than the webbing slide;

positioning the third loop above a chest of a person; and contracting shoulder blades of the person together and down for a predetermined amount of time;

stretching the third loop in response to contracting the shoulder blades of the person.

* * * * *